United States Patent [19]

Galerne

[11] Patent Number: 4,692,844

[45] Date of Patent: Sep. 8, 1987

[54] ADJUSTABLE LIGHT PROJECTOR

[75] Inventor: Jean Galerne, Guerville, France

[73] Assignee: LTM Corporation of America, Hollywood, Calif.

[21] Appl. No.: 754,166

[22] Filed: Jul. 12, 1985

[51] Int. Cl.[4] ..... F21V 19/02; F21V 29/00

[52] U.S. Cl. ..... 362/3; 362/268; 362/289; 362/372; 362/373; 362/293; 362/294

[58] Field of Search ..... 362/3, 6, 268, 289, 362/368, 372, 373, 362, 269, 293, 294, 16

[56] References Cited

U.S. PATENT DOCUMENTS

| | | | |
|---|---|---|---|
| 2,287,328 | 6/1942 | Rose | 362/373 |
| 2,307,301 | 1/1943 | Richardson | 362/373 |
| 3,120,352 | 2/1964 | Akita et al. | 362/293 |
| 3,461,282 | 8/1969 | Martinez | 362/268 |
| 3,642,361 | 2/1972 | Streu | 362/268 |
| 4,183,077 | 1/1980 | Arnold | 362/263 |
| 4,419,716 | 12/1983 | Koo | 362/373 |
| 4,519,020 | 5/1985 | Little | 362/268 |
| 4,602,321 | 7/1986 | Bornhorst | 362/293 |

*Primary Examiner*—Craig R. Feinberg
*Assistant Examiner*—David A. Okonsky
*Attorney, Agent, or Firm*—Beehler, Pavitt, Siegemund, Jagger, Martella & Dawes

[57] ABSTRACT

An electric lamp unit for projecting light to subjects which are being photographed features a housing having an elongated chamber with a lens at one end and a shielded vent at the other end. In the chamber is a carriage on which is mounted a socket for the light bulb and a reflector. The carriage travels in the chamber on parallel rails, one of which is adjustable by a knob outside the housing at the rear to change the location of the carriage. An upper half section of the housing is hinged as a cover section to the lower stationary section for ready access to the chamber. Abundant vent openings are provided, some of which are coincident with adjoining edges of the cover and the stationary sections.

11 Claims, 5 Drawing Figures

ADJUSTABLE LIGHT PROJECTOR

Artificial lighting requirements in the field of photography have heretofore been commonly supplied by use of floodlights. This was the prevailing solution for black and white photography and has been continued to a substantial extent as color photography has progressively supplemented black and white photography.

Floodlighting has, to a large extent, involved large and powerful light sources capable of flooding the subjects and background sought to be photographed with relatively high intensity light where uniformity of illumination has commonly been the objective. There has, however, been a progressive change in lighting needs in response to the development of new color photography processes and increasingly sophisticated equipment, especially as color effects have attracted increased attention is the color television and video field of activity.

Floodlighting of the type heretofore widely prevalent has usually required large pieces of equipment, demanding relatively heavy electrical systems supplying batteries of high intensity light sources. Those sources heretofore available have frequently not been sufficiently satisfactory for a variety of different colors often involved and for different colors effects which may be sought to be produced. Such equipment has not been as amenable to the proper lighting of different locations on a subject or background set where different intensities may readily be needed for different portions of the subject matter.

It is therefore among the objects of the invention to provide a new and improved compact type of light projector which can be effectively provided in units relatively smaller than the floodlighting units heretofore available.

Another object of the invention is to provide a new and improved light projector of relatively moderate power and also relatively compact so that individual units may be located variously about different subject matter and different portions of a set where a variety of types of illumination needs may be present.

Still another object of the invention is to provide a new and improved light projector of relatively compact individual character capable of an appreciable degree of adjustment, both with respect to the intensity and focus of the light source, as well as being of a character such that the character and color of the light source can be readily changed and adjusted.

Further included among the objects of the invention is to provide a new and improved light projector of moderate intensity in relatively compact packages which, though generating an appreciable degree of heat during operation, is sufficiently well ventilated to make it capable of being easily handled and shifted about at will.

Further still among the objects of the invention is to provide a new and improved light projector abundantly adjustable with respect to focus, intensity and color, which can be produced at a moderate price sufficient to make a multiple number of such projectors economically usable, even where the subject matter to be illuminated may involve an appreciable expanse.

With these and other objects in view, the invention consists of the construction, arrangement, and combination of the various parts of the device serving as an example only of one or more embodiments of the invention, whereby the objects contemplated are attained, as hereinafter disclosed in the specification and drawings, and pointed out in the appended claims.

Figure 1:
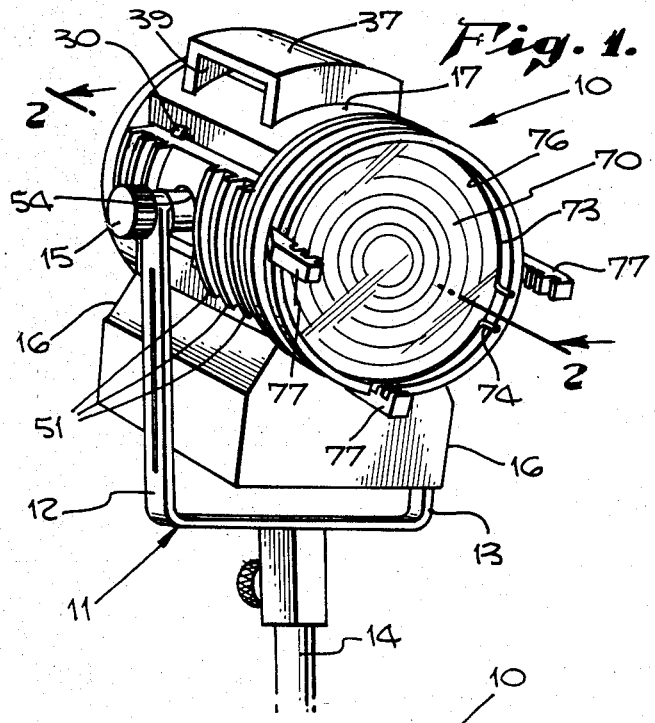
FIG. 1 is a front perspective view of the light projector supported by a mounting bracket.
Figure 5:
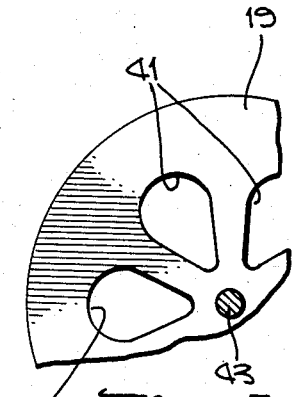
FIG. 5 is a fragmentary cross-sectional view on the line 5—5 of FIG. 2.

In an embodiment of the invention chosen for the purpose of illustration, a complete light projector embodied in a housing 10 is shown carried by a mounting bracket 11 opposite parallel arms 12 and 13 of which are shown at the top of a post 14. At upper ends of the arms 12 and 13 are knobs 15, 15', by means of which the projector is secured to the arms in a desired tilted position of adjustment.

The housing 10 consists in the main of two housing parts, namely, a lower and relatively larger stationary sections 16 and a movable upper section 17. Front and rear walls 18 and 19, respectively, serve with side walls 20 and 21, together with a top wall 22, to encompass a main changer 23. An advantageous arrangement of side walls is as shown, namely, one wherein lower portions of the side walls are carried by the lower stationary section 16 and upper side wall portions 20' and 21' are carried by the movable upper section 17, the top wall 22 being part of the upper section. A lower utility chamber 24 within the lower stationary section 16 and provided with a bottom 25 accommodates electric wiring 26.

Figure 4:
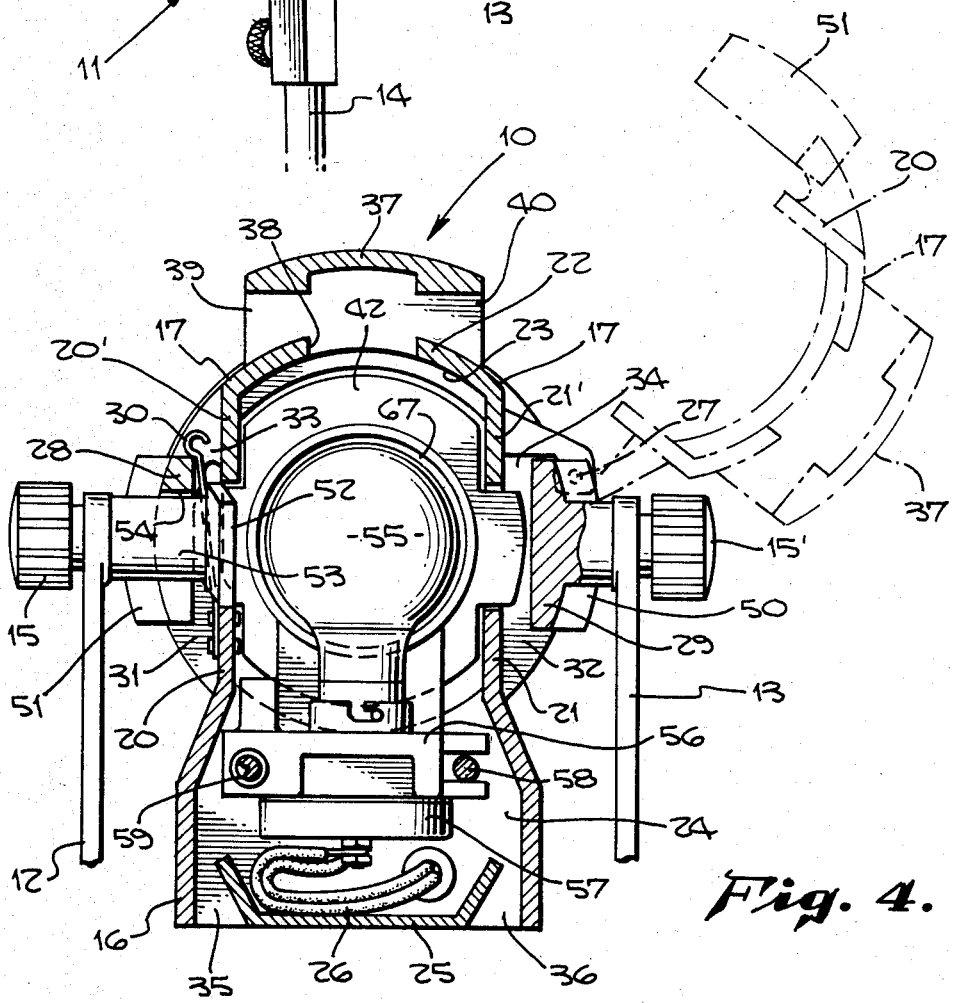
FIG. 4 is a cross-sectional view on the line 4—4 of FIG. 2.

To provide access to the interior of the main chamber 23, the upper movable section 17, as shown in broken lines in FIG. 4, has a hinged connection, a hinge axis 27 of which is located exteriorly with respect to the side wall 21 and its extension 21'. To complete the side wall structure, there is a wing wall 28 on the left side, as viewed in FIG. 4, and a similar wing wall 29 on the right side. The wing wall 28 is in fact carried by the movable upper section 17, whereas the wing wall 29 is a part of the lower stationary section 16. For holding the movable upper section 17 inoperative position, as shown by the solid lines of FIG. 4, there is a spring clip 30 extending upwardly from the side wall portion 20 to a position of engagement with the wing wall 28.

In the interest of providing abundant ventilation for the main chamber 23, it will be noted that both wing walls 28 and 29 are spaced laterally outwardly from the lower side wall portions 20 and 21, in this way providing respective inflow slots 31 and 32. Above the inflow slots are corresponding outflow slots 33 and 34, access to the main chamber 23 being had through the space on the left separating the wall portions 20 and 20' and on the right the wall portions 21 and 21', as viewed in FIG. 4, the line of separation extending as it does throughout substantially the entire length of the chamber.

Additional inflow to the main chamber is also provided on the bottom by slots 35 and 36 on opposite sides of the bottom 25, the slots 35 and 36 admitting air into the utility chamber 24 and from there upwardly into the main chamber 23. On the upper side of the movable upper section 17 is a hood 37 which accommodates a ventilating passage 38 from which outflow air reaches vent slots 39 and 40.

Still further in the interest of providing abundant ventilation for the main chamber 23, there are vent holes 41 in the rear wall 19 protected by a baffle plate, spaced slightly forward of the rear wall 19, as shown in FIG. 4. The baffle plate 42 is removably mounted in position by provision of a screw 43 and knob 44.

As an additional cooling expedient the wing wall 29, which is part of the lower stationary section, supports a series of spaced parallel fins 50. Mounted in this fashion, the wing wall 29 experiences cooling on its inside face by the flow of ventilating air and cooling on its outside face by ambient air in contact with the fins. For the opposite side of the main chamber 23, the wing wall 28, carried as it is by the movable upper section 17, is also provided with a set of spaced parallel fins 51. The fins on each side are sufficient in number to extend for substantially the full length of the housing, except where they straddle the knobs 15, 15'.

On the left side, as viewed in FIGS. 1 and 4, there is an extension tab 52 of the lower portion of the side wall 20 provided with a collar 53 which is engaged by the knob 15. An open recess 54 in the wing wall 28 permits the upper section 17, as exemplified by the wing wall, to straddle the collar 53.

Mounted in the main chamber 23 is a light bulb 55. For supporting the light bulb there is a carriage 56 in which is located a bulb socket 57. In order to have the position of the light bulb 55 adjustable within the main chamber, the carriage 56 is mounted upon parallel rails 58 and 59. The rail 58 is a fixed rail anchored in respectively opposite ends 18 and 19 of the housing. A single shoe 60 of the carriage rides on the rail 58. On the opposite side of the carriage is a pair of shoes 61 and 62, both of which ride on the rail 59. The rail 59 is of special construction in that it is threaded throughout a substantial portion of its length and in threaded engagement with one or both of the shoes 61 and 62. A smooth surfaced cylindrical portion 63 of the rail 59 is rotatably carried by the rear wall 19, there being a cylindrical portion 64 carried by the front wall 18. Rotatably mounted as shown, the rail 59 can be rotated by an exteriorly located knob 65 so as to shift the position of the carriage 56 lengthwise throughout a substantial portion of the length of the main chamber 23.

The carriage 56, in addition to supporting the socket 57 also carries a reflector 67, the lower portion of the reflector 67 being attached to blocks 68 on opposite sides of the carriage. The reflector, customarily provided with a substantially mirrored concave surface at a fixed distance from the light bulb 55, moves with the light bulb in response to manipulation of the knob 65. A relatively light coiled spring 69 may be provided to resist dislodgement of the carriage 56 from a selected position.

In the front wall 18 there is mounted a translucent lens 70 for projection of light emitted by the bulb 55. In order to make it possible to readily remove and change the lens 70, the lens is designed to be contained within an annular recess 71 around a central opening 72 in which it is secured by a resilient ring 73. Finger holds 74 at the ends of the ring 73 to make it possible to contract the ring so as to remove it from an annular groove 75 in order to release the lens 70. Outwardly, of the groove 75 is a horn 76, at the outer edge of which is a trio of auxiliary retention brackets 77 which, in the chosen embodiment, are each provided with a pair of retention recesses 78, 78' for releasable retention of auxiliary lenses (not shown).

Figure 2:
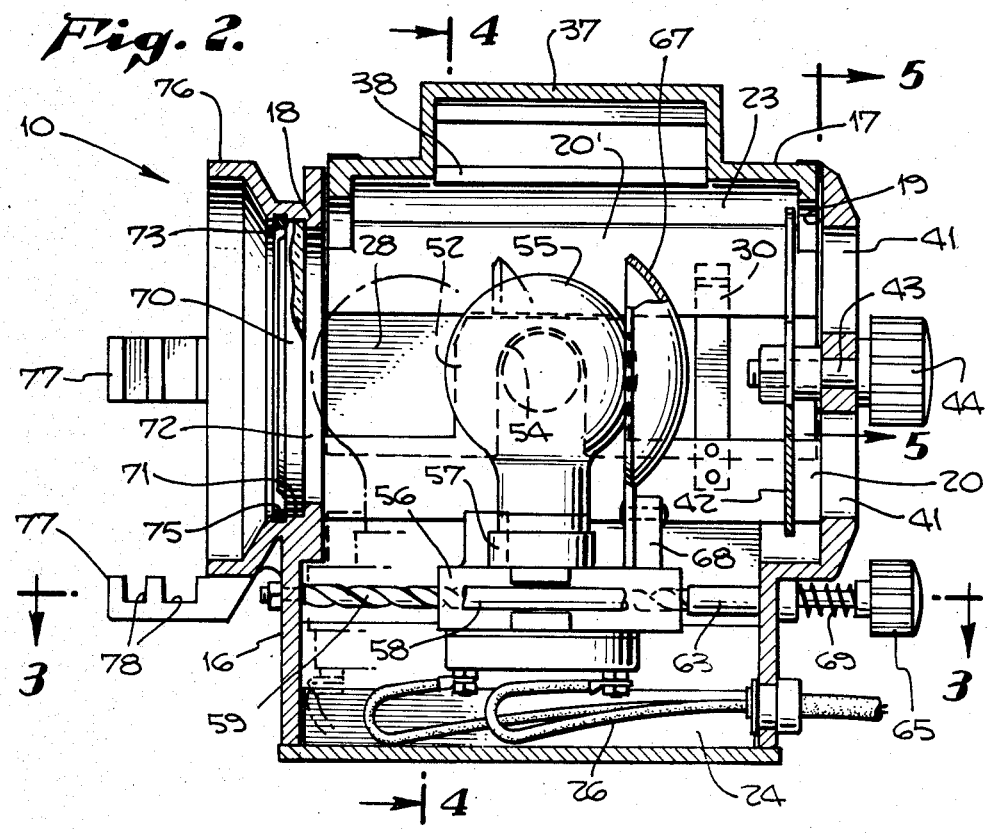
FIG. 2 is a longitudinal sectional view on the line 2—2 of FIG. 1.
Figure 3:
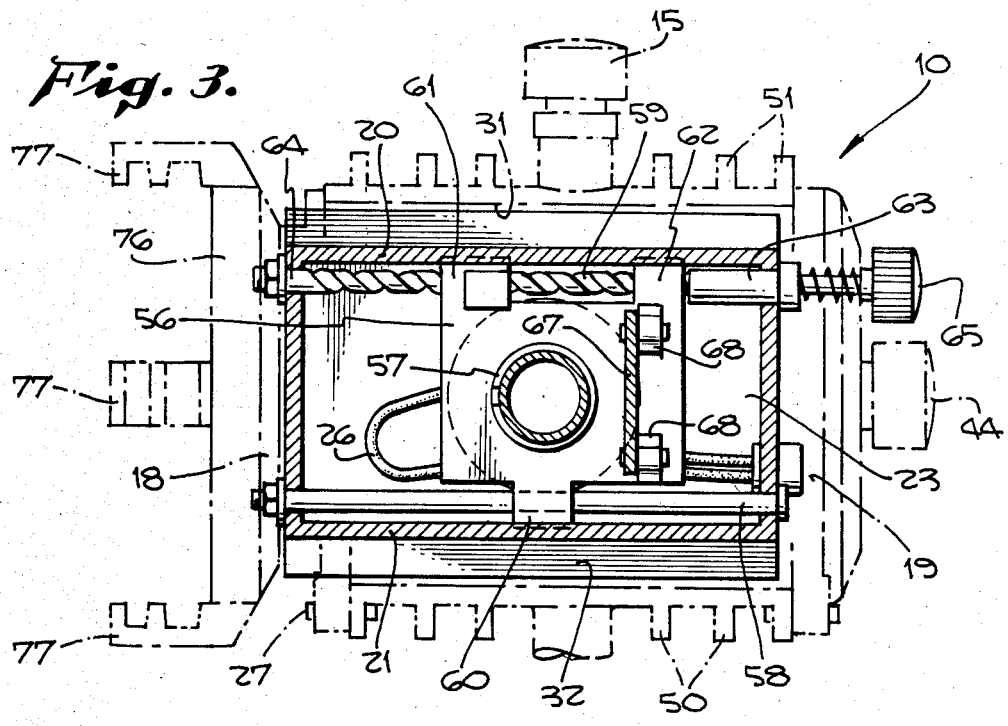
FIG. 3 is a sectional view on the line 3—3 of FIG. 2.

As can be observed in FIGS. 2 and 4, by way of example, the lower stationary section 16 is relatively larger than the movable upper section 17 and moreover is so positioned with respect to the axis of rotation of the knobs 15, 15' that the center of gravity of the lower stationary section 16 is well below the axis of rotation. The consequence of this is a tendency of the housing to retain a position wherein the axis of movement of the carriage and bulb is in a horizontal plane, subject to tilting about the axis of the knobs 15,15' when the need arises for adjustment. Additionally, by having the movable upper section comprise virtually a half section of that portion of the housing devoted to the chamber 23, when the movable section 17 is tilted to the phantom line open position of FIG. 4, there is abundant access to the chamber 23. In consequence, whenever it becomes necessary to replace or interchange a bulb, or to otherwise service the interior of the light projector, the upper section can be quickly released and lifted out of the way to provide the necessary access. The arrangment of lenses and the adjustment capability of the socket is one making possible readily changing the focus and spread of light as well as the color by interchange of not only the lens 70 at its fixed location, but also the interposition of auxiliary lenses in the line of light projection.

While a particular embodiment of the present invention has been shown and described, it will be obvious to those skilled in the art that changes and modifications may be made without departing from the invention and in its broader aspects and, therefore, the aims of its appended claims are to cover all such changes and modifications as fall within the true spirit and scope of this invention.

Having described the invention, what is claimed as new in support of Letters Patent is as follows:

1. An adjustable light projector comprising a housing having side walls, a rear wall and front wall forming a chamber, an opening in the front wall for emission of light and means at the opening for mounting a lens, a carriage having a lamp socket, support means in the chamber extending between the front and rear walls, said carriage having a movable mounting on the support means and adjusting means between the carriage and the housing for shifting the position of the carriage relative to the front wall, a lower stationary section of said housing comprising portions of said side walls and an upper section comprising remaining portions of said side walls, there being a movable connection between the upper section and the stationary section on one side of the housing and a releasable connection on an opposite side of the housing whereby to provide access to said chamber, said remaining portions of said side walls forming in part said upper section of the housing being spaced from said portions of said side walls forming in part said lower stationary section thereby forming vents.

2. An adjustable light projector as in claim 1 wherein said support means comprises parallel rails mounted in the chamber on opposite sides of the carriage and providing a track, one of said rails comprising a rotatable shank having spaced fore and aft helical engagements with the carriage, said rotatable shank having a portion on the exterior of the housing and in operative associated with said adjusting means.

3. An adjustable light projector as in claim 1 wherein said movable connection between the upper and stationary sections comprises one connection element at a side edge of the stationary section and a complementary connection element on a corresponding side edge of the upper section.

4. An adjustable light projector as in claim 1 wherein said housing and the chamber therein are semi-cylindrical in shape, said upper section comprising substantially the upper half of said housing, said movable connection comprising a hinge operable about an axis of rotation parallel to the long axis of said chamber, there being a set of cooling fins on one side of the stationary section and a set of cooling fins on the opposite side of the upper section.

5. An adjustable light projector as in claim 4 wherein there is a mounting bracket having a pair of arms in substantially parallel relationship and on respectively opposite sides of the housing and pivotally adjustable attachment means between the housing and the arms at diametrically opposite locations on the carriage, there being vent means adjacent the pivotal attachment means on both sides of the housing.

6. An adjustable light projector as in claim 5 wherein the center of gravity of the housing is in the stationary section at a location below the axis of rotation of said pivotally adjustable attachment means.

7. An adjustable light projector as in claim 1 wherein said housing and the chamber therein are semi-cylindrical in shape with the long axis adapted to lie in a substantially horizontal plane, said upper section comprising substantially the upper half of said housing, said movable connection comprising a hinge operable about an axis of rotation parallel to the long axis of the chamber, there being inflow vent slots in the housing at diametrically opposite locations below the long axis of the chamber and outflow vent slots in the housing at diametrically locations above the long axis of the chamber.

8. An adjustable light projector as in claim 7 wherein vent slots on the side of the housing adjacent the hinge axis are at locations diametrically inward with respect to the location of the hinge axis.

9. An adjustable light projector as in claim 7 wherein there is outflow vent means in the rear wall and a baffle plate having an attachment to the housing at a location between the rear wall vent means and the carriage, a plurality of fin segments on both sides of the housing, said fin segments extending arcuately to positions encompassing upper and lower sides of the housing above and below the long axis of the housing.

10. An adjustable light projector as in claim 7 wherein there is a plurality of fin segments on both sides of said upper section of the housing, said segments extending arcuately to operating positions encompassing upper and lower sides of the housing at locations above and below the long axis.

11. An adjustable light projector as in claim 10 wherein said fin segments are at locations both forward and rearward of the midsection of the housing.

* * * * *